US008747283B2

(12) United States Patent
Valakh

(10) Patent No.: US 8,747,283 B2
(45) Date of Patent: Jun. 10, 2014

(54) PERSONAL EXERCISER FOR HEAD AND NECK MUSCLE STRENGTHENING AND METHOD THEREFOR

(76) Inventor: Ina Valakh, Venice, FL (US)

( * ) Notice: Subject to any disclaimer, the term of this patent is extended or adjusted under 35 U.S.C. 154(b) by 337 days.

(21) Appl. No.: 13/420,788

(22) Filed: Mar. 15, 2012

(65) Prior Publication Data

US 2012/0252633 A1 Oct. 4, 2012

Related U.S. Application Data

(60) Provisional application No. 61/469,981, filed on Mar. 31, 2011.

(51) Int. Cl.
*A63B 21/00* (2006.01)

(52) U.S. Cl.
USPC ..... 482/11; 482/121

(58) Field of Classification Search
USPC ..... 482/11, 121, 148; 128/859, 860, 861; 433/6, 34, 70, 71, 80; D24/181
See application file for complete search history.

(56) References Cited

U.S. PATENT DOCUMENTS

| | | | | |
|---|---|---|---|---|
| 5,556,357 | A | 9/1996 | Hanna | |
| 6,514,176 | B1 | 2/2003 | Norton | |
| 7,083,548 | B1 | 8/2006 | Moore et al. | |
| 7,153,237 | B2 | 12/2006 | Norton | |
| 7,662,066 | B2 | 2/2010 | Ferrara | |
| 2003/0078139 | A1 | 4/2003 | Norton | |
| 2003/0232699 | A1 | 12/2003 | Norton | |
| 2005/0192157 | A1 * | 9/2005 | Norton | 482/11 |
| 2009/0017992 | A1 * | 1/2009 | Seybold | 482/11 |

* cited by examiner

*Primary Examiner* — Jerome W Donnelly

(57) ABSTRACT

A personal exerciser for head and neck muscle strengthening comprises at least one part, intended to be inserted in a user's mouth during exercising and another part intended to cover the area around the lips, mouth and chin to prevent wrinkle formation and choking during exercising. A multiple layered structure is used in the form of a deformable, pliable composition covered with durable, resilient, elastomeric material. This structure allows fitting the personal exerciser inside the mouth and around the lips, mouth and chin of each unique individual. Isomeric and isotonic exercising of the head and neck muscles are performed simultaneously utilizing the inherent resistance of the elastomeric material. A method of use of the personal exerciser for head and neck muscles is adaptable for use in speech therapy, smoking cessation therapy, obesity treatment and treatment of complications from cosmetic surgeries and procedures.

6 Claims, 4 Drawing Sheets

PERSONAL EXERCISER FOR HEAD AND NECK MUSCLE STRENGTHENING AND METHOD THEREFOR

CROSS REFERENCE TO RELATED APPLICATIONS

This application claims priority to U.S. provisional application Ser. No. 61/469,981, entitled "Personal Exercisor for Head and Neck Muscles Strengthening and Method Therefor," filed Mar. 31, 2011.

BACKGROUND OF THE INVENTION

The field of endeavor to which the present invention pertains is generally to exercise devices for conditioning or developing muscles located in the region above the shoulders of a user. More particularly, the present invention relates to the field of isotonic or/and isometric exercises for strengthening the head and neck muscles, that are performed with the personal exerciser.

The term "muscles of the head" expressed in the present invention means the frontalis, corrugator, orbicularis, temporalis, temporo-parietalis, auricular muscles, occipitals and epicranium and further include the rest of the muscles of facial expression, muscles of mastication and the muscles of the tongue.

The term "muscles of the neck" expressed in the present invention means muscles above the shoulder of the user, excluding muscles of the head.

Unfortunately, wrinkles appear from repetitive facial muscle movements. Well known examples are wrinkles around the lips of heavy smokers; facial lines lateral to the eyes commonly known as crow's feet; frown lines often associated with sagging of the eyebrows that give a tired or aged appearance; and creasing between the eyebrows at the root of the nose commonly known as the worry line.

Various devices have been developed for conditioning and exercising facial muscles and for rehabilitation after different illnesses and injuries. While these devices fulfill their respective and particular objects and requirements, the majority of them are using only an isotonic approach of exercising and focus only on repetitive movements of the muscles of the mouth and around the mouth (particularly muscles of mastication).

Because of nature of the facial muscles, an isotonic exercising approach takes excessive time and an extraordinary number of repetitions to develop facial muscles. Such time-consuming, repetitive facial exercises are not popular in the general population and thus quick fix measures like face lifts, fillers and BOTOX injections are still in demand regardless of great health risk and side effects. Some of the fillers are permanent and, therefore, if the consumer develops a problem, it is frequently lifelong and requires surgery to correct.

Isometric exercises, on the other hand, are the best for toning muscles since it enables maximum muscular contraction without wrinkle creation.

The need for an exerciser to enable a combined isotonic and isomeric approach for exercising of the whole muscle system above the shoulder simultaneously arises therefore.

Thus, U.S. Pat. No. 5,556,357 to Hanna, issued Sep. 17, 1996, discloses an exerciser device for exercising the muscles in the face, chin and neck. This exerciser device is complex. It must be assembled prior use, it includes a guard strip for passing over teeth and rigid durable buttons applied to the corners of user's mouth. Tension is applied to the teeth during exercises. Mechanical injury to mucus membranes may result from pressure applied by buttons against mouth corners.

Apparatus for enhancing exercises and methods of using same by Norton in U.S. Pat. No. 6,514,176 issued Feb. 4, 2003 and U.S. Pat. No. 7,153,237 issued Dec. 26, 2006 and in published U.S. Patent Applications 2003/0078139 and 2003/0232699 include a substantially rigid assembly for increasing isometric resistance, which requires shaping and sizing to fit the user's mouth prior it use. When used as an isotonic exercising aid, this apparatus needs to be flexible or semi-flexible, hence the user unable to use the same apparatus for both isotonic and isomeric approach. Another disadvantage is altered natural patterns of the breathing and saliva swallowing due to keeping the mouth of the user partially open during exercises, which can lead to aspiration of saliva in the user's airways.

U.S. Pat. No. 7,083,548 to Moore et. al., issued Aug. 1, 2006, discloses a soft, flexible, pliable one-piece isometric exercise mouth tool for conditioning facial muscles. Due to its light weight and small dimensions, this tool may occlude the human trachea in case of accidental aspiration during exercises. Ridges on the body portion of this tool are pressing against the roof of the mouth of the user during repetitive motions and may cause mucus membrane injury. This tool carries out the natural salivation process, collecting saliva in the hollow body, and does not provide any support for lips and skin around the mouth, which leads to wrinkle formation around the lips.

U.S. Pat. No. 7,662,066 to Ferrara, issued Feb. 16, 2010, is a complex assembly of several parts including a spring which is difficult to disinfect, wash and dry.

Such prior devices are not adjustable for every unique individual, are complex, difficult to clean and dry, and are comprised of parts with hinges and moving pieces. Thus there is a need for a simple, portable, inexpensive, hygienic and safe personal exerciser.

There are no known devices on the market for engaging in exercising activity of frontalis, corrugator, orbicularis, temporalis, temporo-parietalis, auricular, glabellar and occipitals muscles simultaneously.

BRIEF SUMMARY AND OBJECTS OF THE INVENTION

The principal advantage of the present invention consists in providing a personal exerciser for head and neck muscle strengthening (referred to herein as a personal exerciser) comprising a multilayered-composite structure including:

(a) an inner first layer formed of a deformable, pliable composition which in use provides exact fitting of the contours inside and around the mouth and chin of the user during exercises, and (b) a second exterior layer or layers each formed of an elastomeric sheet or film of waterproof, durable, resilient material that possesses the characteristic of ability to elongate and return to its original dimensions. The exterior layer or layers, in use, contact the user's mucus membranes and skin during exercising and serve to cover the first layer.

Because of the pliable and deformable nature of the first layer of the present invention, the personal exerciser doesn't have an exact fixed shape prior to use. Instead, it is deformable and easily takes shape of the oral cavity and of the area around the lips, mouth and chin of each unique individual user from the very first use of the personal exerciser.

There are some suppliers on the market that produce a variety of high-performance materials possessing desirable qualities suitable for the present invention. Thus, for example, products made from polyisoprene or latex by Kent Elastomer Products, Inc. retain long-term flexibility, outstanding shelf life and have physical properties that give opportunities for outstanding design flexibility.

However, with the object of providing an environmentally friendly product, in accordance with one aspect of the invention, natural materials instead of synthetic plastics may be used for the first layer in the present invention. Thus, milled flax seed activated with water in proportion approximately 2:1, with a small amount of preservatives provides desirable characteristics for the first layer in practice of the invention.

A layered, composite structure enables the facial skin protective component of the personal exerciser to embrace unique facial contours of a user firmly, gently and without adhesion, while retaining skin in a stable position.

A potential user obtains the personal exerciser in a deformable pre-shaped condition, which is comprised of: a mouth part intended to be placed in the oral cavity of the user during exercises and accounts for approximately 30 percent of the entire volume of the personal exerciser; and a skin protective shield part intended to protect a user from facial wrinkle formation, which may result from repetitive facial muscle movements, and also from accidentally choking while exercising.

Any air trapped between layers of the mouth part structure of the personal exerciser and the resilient second layer or set of layers introduces a beneficial delicate resistance during sucking and compression movements of the tongue and lips against the mouth-insertible component of the exerciser. A smooth surface and exact fitting prevents irritation, injury and pressure points of the mucus membranes of the mouth.

According to another embodiment, the mouth part and the skin protective shield part of the present invention can be made of different materials and substantially joined to each other.

The flexible, pliable and resilient structure of the present invention allows pressing the personal exerciser against any muscles of the face which need to be exercised in the order to stabilize skin during repetitive muscles flexions, extensions and contractions.

Having the personal exerciser for neck and head muscle strengthening, the user is able to perform various isotonic and isometric exercises by sucking and/or compressing the mouth part of the exerciser with different positions of the mouth part in the oral cavity of the user while the skin protective shield part is pressed against the skin around the lips, mouth and chin of the user.

The neck and head muscles in addition to mouth muscles should be engaged in action by exertion during suction and compressing movements, while the area around the eyebrows is alternately elevated and relaxed, and areas around the ears and top, sides and back of the head and neck muscles can be exercised as well by alternating contraction and relaxation.

The personal exerciser can be used for multiple durations and a variety of exercises in a number of positions for exercising head and neck muscles.

The present invention is designed for use on a daily basis to strengthen the muscles of the head and neck, using both isometric and isotonic techniques, employing a majority of the head and neck muscles and applying a safe limited resistance, to perform light exercises at the beginning, by pressing the mouth part of the invention against the roof of the mouth by tongue, producing suction motions while pressing the skin protection shield against the skin around the lips, mouth and chin of the user.

As the muscles are strengthened, continued exercise with slightly more resistance obtained by manually pulling the skin protective shield away from the mouth area is beneficial, the mouth part being positioned in the oral cavity according to the previously described system of exercises.

Employment of complex repetitive movements can also be used to strengthen the head and neck muscles.

It is an object of the invention to provide a personal exerciser which can be shaped and fitted exactly to every unique individual from the very first use of the personal exerciser.

It is an object of the invention to provide a personal exerciser which is simple, portable, inexpensive, and safe.

It is a further object of the invention to provide a personal exerciser with features for preventing new wrinkle formation caused by repetitive facial movements during exercises which involve pressing a skin protective shield firmly against the skin around the lips, mouth and chin of the user.

It is an object of the invention to provide a personal exerciser for engaging all groups of muscles of the head and neck, including frontalis, corrugator, temporalis, temporo-parietalis, auricular, occipitalis and epicranium muscles all at once in exercising activity, which efficiently uses the time available for exercising.

It is an object of the invention to provide a method of strengthening neck and head muscles of the user for reducing signs of aging and illnesses, including "crow's feet" and "double chin".

It is another object of the invention to provide a personal exerciser for neck and head muscles with a shape and size that is safe for the user and which prevents an accidental aspiration of it.

It is an object of the invention to provide a personal exerciser which can be used in any conceivable situation suitable for exercising.

It is yet another object of the invention to provide a personal exerciser for physical and speech therapy to treat health problems such as head and neck muscle malfunctions due to various medical conditions.

It is an object of the invention to provide a personal exerciser which can be used while an individual is exercising other body muscles.

It is an object of the invention to provide a personal exerciser which can be used for muscle exercises not limited to the mouth area. The exerciser can help to stabilize skin of any facial region and hold onto skin during facial yoga or other facial exercises.

It is an object of the invention to provide an isotonic/isometric exercise method for head and neck muscles that can be readily and inexpensively adapted to individuals having quite different physical characteristics.

It is an object of the invention to provide an isotonic/isometric exercise method for head and neck muscles that have more then one safe level of resistance.

It is also an object of the invention to provide an isotonic/isometric exercise method that engages a majority of the head and neck muscles so as not to require lengthy exercise sessions.

It is an object of the invention to provide a personal exerciser useful for limbering or unlocking faces frozen by BOTOX and other forms of cosmetic surgery.

It is a further object of the invention to provide a personal exerciser that can be easily cleaned and dried.

It is an object of the invention to provide a personal exerciser that is so user-friendly that it will be preferable for the user to exercise and receive healthful benefits from it. Thus it also minimizes bad human habits such as smoking, overeating, biting nails, and so forth.

It is an object of the invention to provide a personal exerciser that is environmentally friendly and easy to recycle.

Other objects and advantages of the present invention will become apparent from the following description of the preferred embodiments when considered in connection with the accompanying drawings.

Before explaining at least one embodiment of the invention in detail, it is to be understood that because of the pliable and deformable nature of the material used in the practice of the invention, the personal exerciser does not have an exact specific shape and size prior to use. Instead, the exerciser easily conforms to the shape and size of the oral cavity. The area of the device around the lips, mouth and chin also conforms to the features of each unique individual user from the very first usage of the personal exerciser.

BRIEF DESCRIPTION OF THE DRAWINGS

The Description of the Invention will be better understood with reference to the following figures wherein like references indicate similar elements.

DETAILED DESCRIPTION OF THE INVENTION

Figure 1:
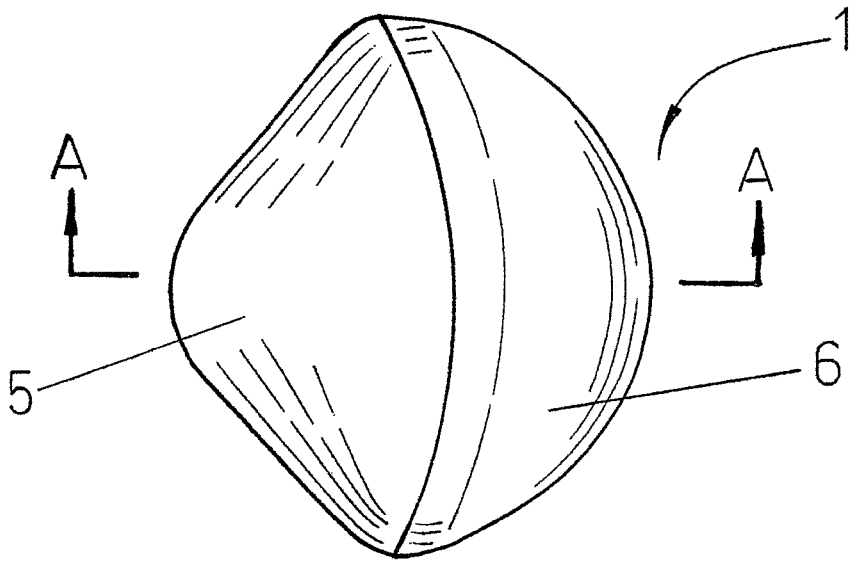
FIG. 1 is a illustration plan view of an inventive personal exerciser.
Figure 2:
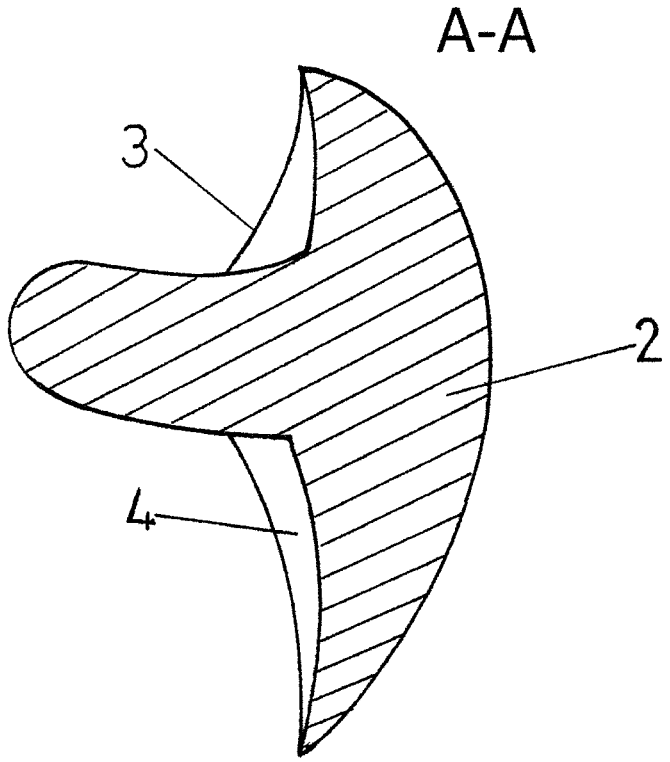
FIG. 2 is a cross-sectional view of the personal exerciser shown in FIG. 1 along line A-A.
Figure 3:
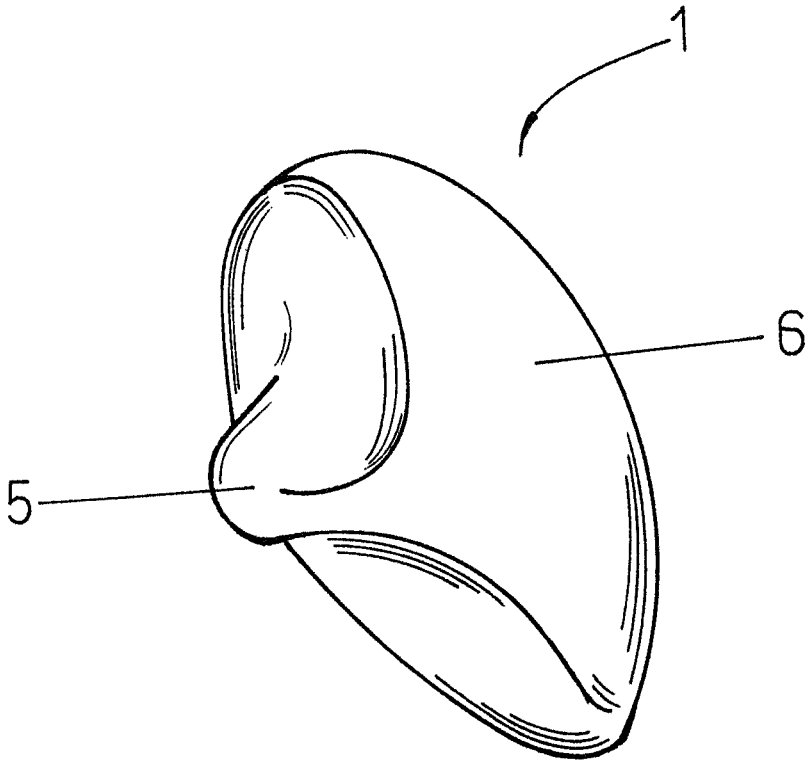
FIG. 3 is a perspective view of the personal exerciser of FIG. 1.

The present invention is not limited in its application to the details of arrangements of the components set forth in the following description or illustrated in the drawings. The invention is capable of other embodiments or of being carried out in various ways. The phraseology and technology employed herein is for purpose of description and should not be regarded as limiting.

The personal exerciser for head and neck muscles strengthening 1 (referred to herein as the personal exerciser), as shown in the drawings may comprise an inner first layer 2 formed of a deformable, pliable composition which in use provides a close fit matching closely the contours inside and around the mouth and chin of the user during exercises and which is covered by an outer elastomeric second layer 3.

Outer layer or set of layers 3 may be formed of a commercially available elastomer such as polyurethane, polyisoprene or latex sheets or films, or made by custom dipping from natural or synthetic latex which can maintain structural integrity after the cycles of exercising, disinfection, washing and drying, and which is suitable to be in contact with user's mucus membranes during exercises.

There may be variable amounts of air 4 between inner layer 2, outer layer 3 and between every layer of the set of layers 3 if multiple layers of sheets or films are present.

Figure 4:
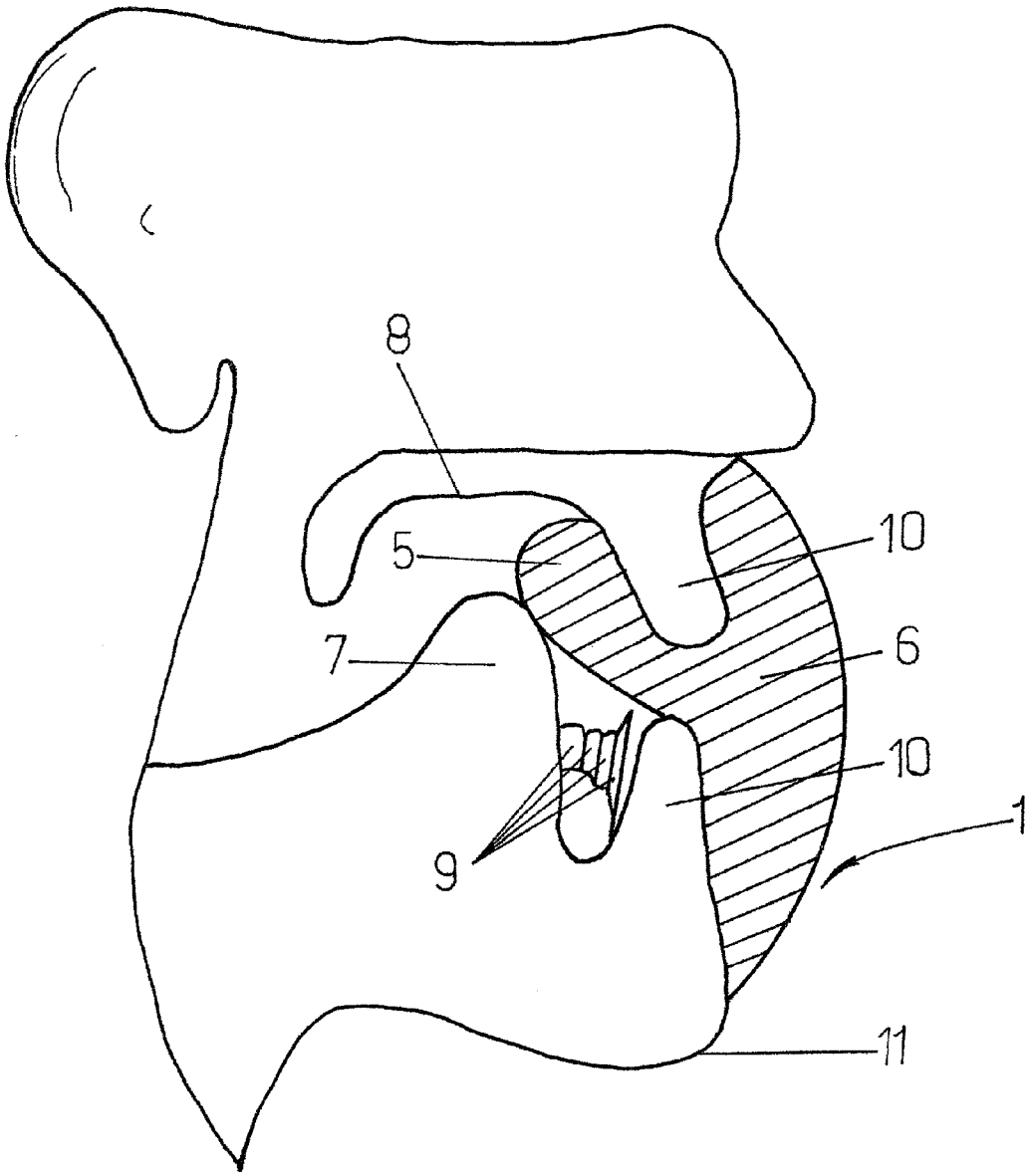
FIG. 4 is a fragmentary sectional view of the exerciser of FIG. 1 in the user's mouth during initial positioning thereof.
Figure 5:
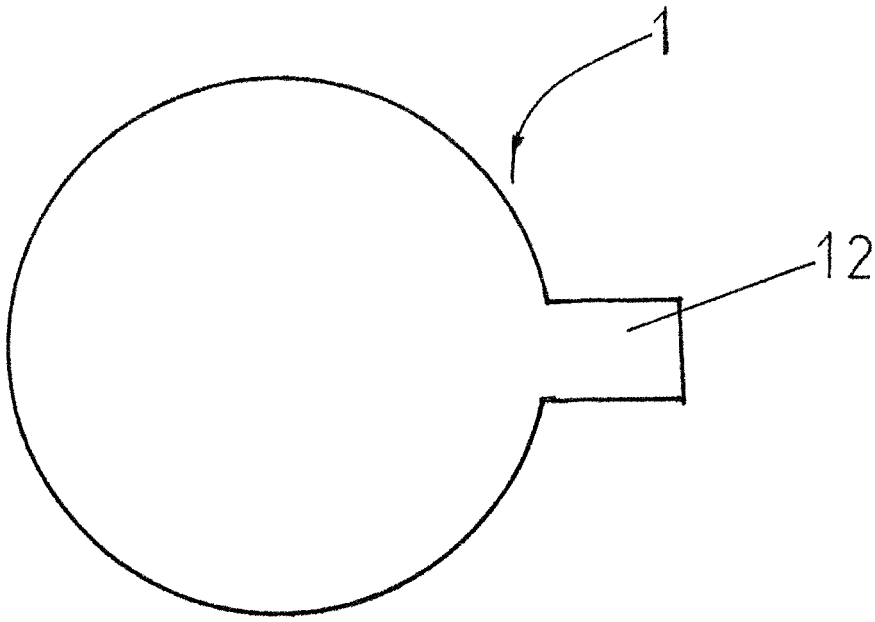
FIG. 5 is a side elevational view of a personal exerciser illustrating a preferred simple means of construction thereof.
Figure 6:
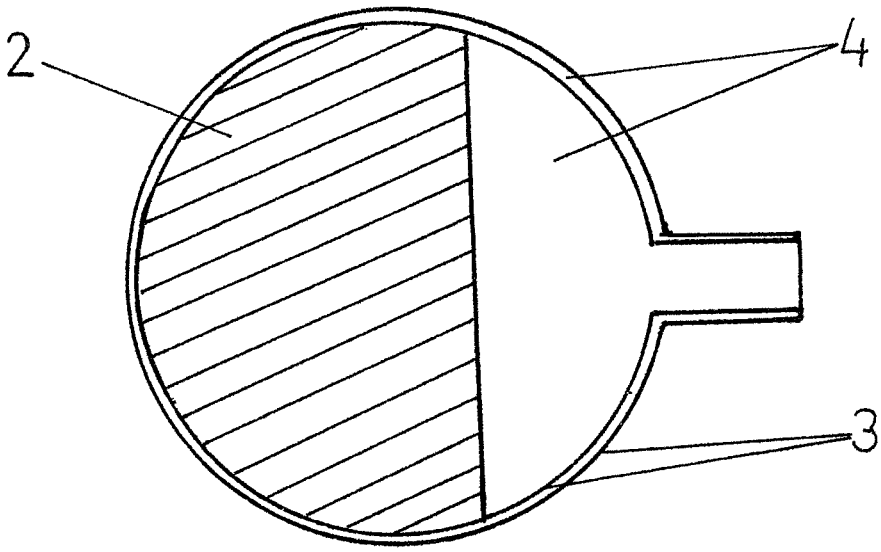
FIG. 6 is a central cross-sectional view of the exerciser of FIG. 5.

For better understanding of the design of the inventive personal exerciser, the preferred embodiment of the personal exerciser 1 in FIGS. 1 to 4 is shown with one outer layer 3. According to another embodiment, the personal exerciser in FIGS. 5 and 6 is shown with two outer layers 3. The number of outer layers 3 may be varied, depending on the properties of the elastomeric material used for layers 3.

The personal exerciser 1 as represented in FIGS. 1 to 4, after the very first usage, presents a mouth part 5, intended to be placed inside the oral cavity of a user and a skin protective shield part 6, intended to protect skin around the lips and chin from wrinkle formation and from accidental aspiration or choking during repetitive exercises.

The personal exerciser 1 may come to the user in preformed shape, having the mouth part 5 and skin protective shield 6 as represented in FIGS. 1 to 4.

As already noted, because of the pliable and deformable nature of the material used in the practice of the invention, the personal exerciser does not have an precise specific shape and size prior to use. Instead, the exerciser easily conforms to the shape and size of the oral cavity. The area of the device around the lips, mouth and chin also conforms to the features of each unique individual user from the very first usage of the personal exerciser. In order to shape and fit the personal exerciser 1 for individual usage, the user, as represented in FIG. 4, inserts mouth part 5 into his own oral cavity between tongue 7 and hard palate 8, having the skin protective shield part 6 pressed firmly against the skin around the lips and chin of the user and begins to perform sucking motions. The tongue 7 automatically positions itself by pressing mouth part 5 against the roof of the mouth. Thus, as a result, mouth part 5 takes a shape which is comfortable for this particular unique individual user. This step shapes the personal exerciser 1 to fit exactly to the user's oral cavity and helps to avoid pressure points on the user's mucus membranes as well as preventing wrinkle or skin fold formation during exercises.

Some amount of air 4 between inner layer 2 and outer layer or set of layers 3 generally enters between the layers due to the resilient nature of the material which the layers 3 are made of, thus allowing exercising to be pleasant and comfortable without undue irritation or injury to mucus membranes.

Although there are various positions for the personal exerciser 1 during exercising, some general positions must be employed in every exercising session which initially should last 30 to 60 seconds three times daily and then may be gradually increased to 10 to 15 minutes daily.

A method of strengthening neck and head muscles includes the following general positions and exercises: performing isotonic and isometric exercises of the head and neck muscles simultaneously by sucking the mouth part 5 of the personal exerciser 1 while pressing the skin protective shield part 6 against the skin around the lips, mouth and chin of the user and engaging neck and head muscles additional to mouth muscles by exertion during suction and compressing movements when:

i) having the mouth part 5 of the personal exerciser 1 in place between tongue 7 and hard palate 8 of the user; then ii) having the mouth part 5 of the personal exerciser 1 in place between teeth 9 and lips 10 of the user; then iii) having the mouth part 5 of the personal exerciser 1 in place between tongue 7 and hard palate 8 of the user while tension is applied by pulling the skin protective shield part 6 manually away from the user; then iv) having the mouth part 5 of the exerciser 1 in place between teeth 9 and lips 10 of the user while tension is applied by manually pulling the skin protective shield part 6 by user's hands away from the user.

v) the user alternately presses and releases upper lips against lower lips while holding mouth part 5 between lips 10 and skin protective shield 6 against lips 10 and chin 11 in order to stabilize skin.

vi) the user presses the tongue 7 against the mouth part 5 while holding skin protective shield 6 against lips 10 and chin 11 in order to produce resistance during exercise and prevent wrinkle formation.

During the first week of exercising with the personal exerciser, the user should have a mirror available for viewing to establish a habit of performing general positions and exercises correctly. The position of the user is referred to in each of the exercises as eyes forward and head straight. Positioning and exercising are performed correctly when suction motion is applied to the mouth part 5 by the user's tongue 7, noting that:

i) the user's neck muscles are visibly engaged in alternating contraction and relaxation; and ii) the user's forehead muscles (frontalis and corrugator supercilii) and muscles around the eyes (orbicularis oculi) are engaged in action by elevating user's eyebrow areas and opening user's eyes wider;

iii) user's occipitalis muscles are engaged in contracting and relaxation. User can check the motion by feeling scalp movements on the back of the head with his/her hand;

iv) user's temporalis and auricular muscles are visibly engaged in exercising by slightly moving the area above and around user's ears.

The user benefits more by repetition and by increased resistance. Resistance is applied by pulling skin protective shield part 6 by hand away from the user. The resistance applied should be less than the muscles are capable of overcoming. Resistance during exercises can be varied, if desired, by moving the hand farther away from or closer to the mouth.

The personal exerciser 1 can be used for any facial or yoga facial exercises as protection from skin and wrinkle formation by pressing the personal exerciser 1 against the area which is engaged in exercising.

FIGS. 5 and 6 illustrate a construction of the personal exerciser 1 using presently readily available materials. Pliable material of the first inner layer 2 can be made from the mixture of the milled flax seed and water solution. The outer layer or set of layers 3 have a balloon-like shape with an aperture 12 and may be made by custom dipping from natural or synthetic latex. Aperture 12 also serves as a portal of entry for placement of inner first layer 2 inside of the one of more of the outer layers 3. Aperture 12 may be sealed and flush-mounted or may be used as a handle during exercises. The aperture can be closed by means of a band or cord.

Many other modifications and variations of the present invention will be apparent to those skilled in the art. For example, material of the inner first layer 2 may be also made from a mixture of starch, such as cornstarch, corn syrup, dextrose, gelatin, etc. or made from an elastomer or polymeric plastic sheet material having sufficient integrity to meet the physical quality requirements of inner layer 2.

According to another embodiment, mouth part 5 and skin protective shield part 6 of the present invention can be made of different materials and joined to each other. According to a yet further embodiment, insertible mouth part 5 and skin protective shield part 6 can be made of one layer of the same material which should be durable, flexible, waterproof, pliable, and resilient.

The present invention has to be made from material durable enough to withstand pressing, sucking and twisting, which may exert tensile, rotational and compressive forces.

I claim:

1. A method of strengthening head and neck muscles of a user comprising the steps of:

a) providing a personal exerciser for head and neck muscles strengthening, said personal exerciser having a mouth part intended to be placed in the mouth of the user and a skin protective shield part having larger dimensions than said mouth part intended to protect skin of the user from wrinkle formation during repetitive exercises, wherein each part comprises a composite structure comprising:

i) An inner first layer formed of a deformable, pliable composition which is deformable when inserted orally to provide a comfortable fit of said personal exerciser in the contours inside and around the lips, mouth and chin of the user during exercising;

ii) one or more outer layers covering said inner first layer and being formed of an elastomeric, waterproof, durable, resilient, material capable of elongation and return, suitable for contacting the user's mucus membranes and skin during exercising;

b) placing the mouth part of the personal exerciser between the tongue and hard palate of the user, while having the skin protective shield part pressed firmly against the skin around the user lips, mouth and chin; and, c) sucking on said mouth portion of said personal exerciser while pressing the skin protective shield part against the skin around the mouth and chin of the user firmly, thereby fitting said personal exerciser in the oral cavity of the user and continuing said movements whereby neck and head muscles of the user are strengthened.

2. A method of strengthening head and neck muscles as in claim 1 further comprising the step of:

a) performing isotonic and isometric exercises by producing repetitive sucking or/and compressing motions on said mouth part of the personal exerciser as in claim 1 while pressing said skin protective shield part against the skin around the lips, mouth and chin of the user and engaging neck and head muscles in addition to the mouth muscles by exertion during suction and/or compressing movements while:

i) having the mouth part of said personal exerciser as in claim 1 in place between the tongue and hard palate of the user; and ii) having the mouth part of said personal exerciser as in claim 1 in place between the teeth and lips of the user; and, iii) producing suction and causing compressing movements by tongue and lips while tension is applied by pulling the skin protective shield part manually away from the user.

3. A personal exerciser adapted for use in the method of claim 1 for head and neck muscle strengthening wherein the mouth part comprises a deformable, pliable composition which, when inserted orally, conforms to the interior oral contours of an individual user and the skin protective shield part has a portion that can be pressed against the facial skin during facial exercises for stabilizing skin and preventing wrinkle formation.

4. A personal exerciser according to claim 3 wherein said pliable composition comprises milled flax seeds, or a polymeric elastomer or a mixture of starch, corn syrup, dextrose and gelatin.

5. A method according to claim 1, adapted for use in speech therapy, smoking cessation therapy, obesity treatment and treatment of complications from cosmetic surgeries and procedures.

6. A personal exerciser according to claim 3 wherein the inner pliable layer comprises a mixture of milled flax seed and water or starch and gelatin and an outer layer comprises a balloon-like shape formed by dipping a form into a latex, said outer layer having an aperture that provides a portal of entry for placement of said inner layer within said balloon-like shape.

* * * * *